United States Patent [19]

Fredericks

[11] 3,957,383

[45] May 18, 1976

[54] CURB PROTECTION DEVICE AND METHOD

[76] Inventor: Robert H. Fredericks, 1559 Connell Road, Charleston, W. Va. 25314

[22] Filed: Sept. 4, 1973

[21] Appl. No.: 393,937

[52] U.S. Cl. ..... 404/8; 404/72
[51] Int. Cl.[2] ..... E01C 11/22
[58] Field of Search ..... 404/7, 8, 3, 6

[56] References Cited

UNITED STATES PATENTS

| | | | |
|---|---|---|---|
| 442,060 | 12/1890 | Landis | 404/7 X |
| 457,886 | 8/1891 | Landis | 404/7 |
| 537,047 | 4/1895 | Landis | 404/8 |
| 1,609,077 | 11/1926 | Fischer | 404/8 X |
| 1,909,551 | 5/1933 | Ross | 404/8 |
| 2,033,028 | 3/1936 | Gaisman | 404/8 |
| 3,379,105 | 4/1968 | Lynch | 404/8 |
| 3,520,082 | 7/1970 | Smith | 404/7 X |
| 3,663,808 | 5/1972 | Baatz | 404/7 X |
| 3,762,113 | 10/1973 | O'Mullan et al. | 404/7 X |

FOREIGN PATENTS OR APPLICATIONS

| | | | |
|---|---|---|---|
| 39 | 1/1881 | United Kingdom | 404/7 |
| 578,714 | 7/1958 | Italy | 404/8 |
| 1,560,190 | 2/1969 | France | 404/8 |

*Primary Examiner*—Roy D. Frazier
*Assistant Examiner*—Thomas J. Holko
*Attorney, Agent, or Firm*—Depaoli & O'Brien

[57] ABSTRACT

A flexible fiberglass shield, of L-shaped cross section and conforming to the size, curvature, and shape of a molded curb between vehicular pavement and walkway areas, and a method for affixing a plurality of shields to a curb by bonding with a cushioning coating of asphalt emulsion and securing with driven pins along the rims thereof to provide impact resistance and protection against freezing and salt damage.

3 Claims, 5 Drawing Figures

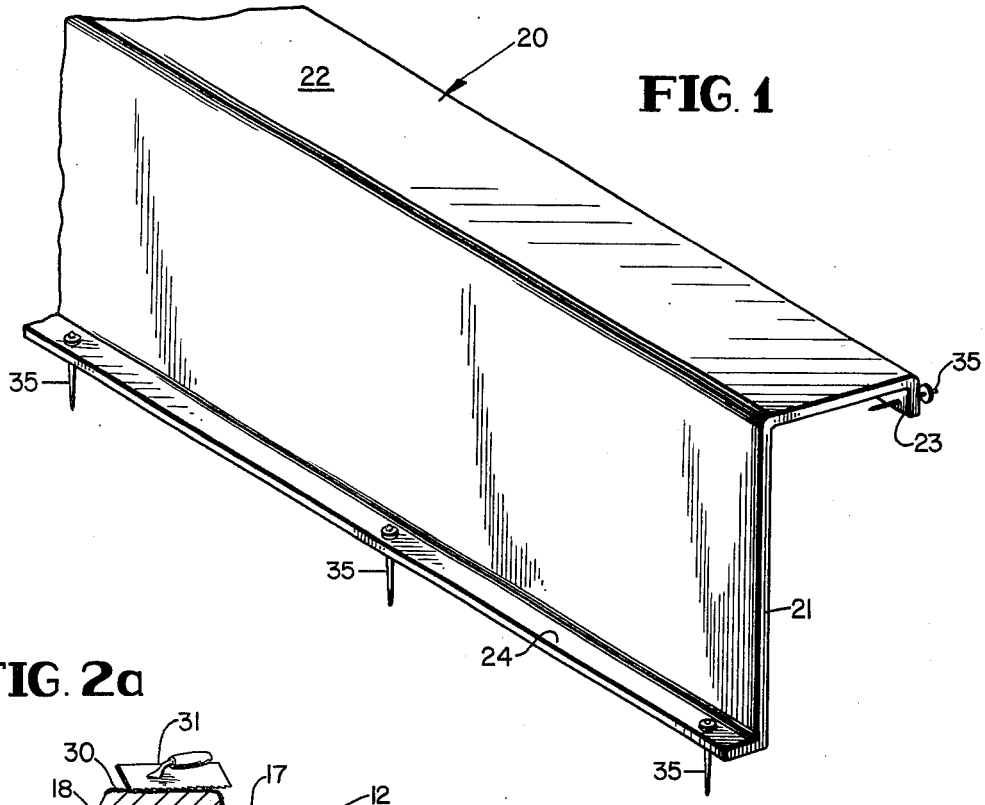
FIG. 1
FIG. 2a
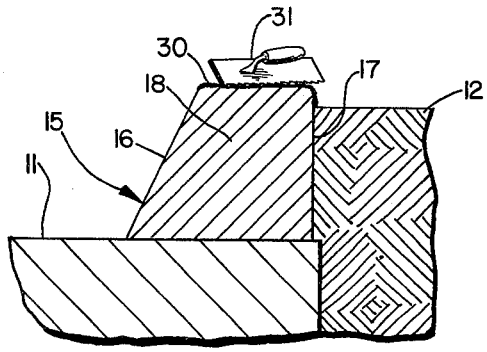
FIG. 2d
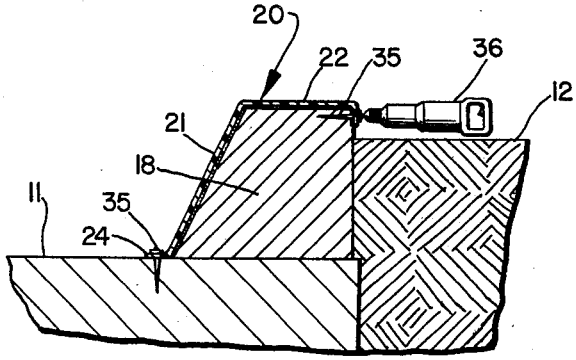
FIG. 2b
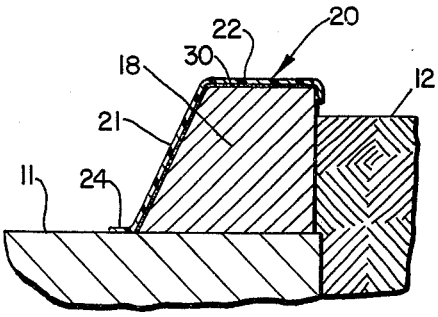
FIG. 2c
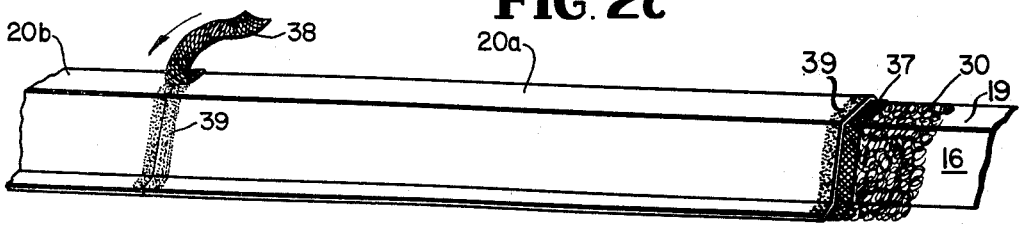

CURB PROTECTION DEVICE AND METHOD

BACKGROUND OF THE INVENTION

1. Field of the Invention

This invention relates to devices and methods for protecting curbs alongside areas exposed to moving vehicular traffic. It particularly relates to flexible plastic devices for shielding base structures from impact forces and methods for application thereof.

2. Review of the Prior Art

Shield-type curbs of metal have been known for many years, as taught in U.S. Pat. Nos. 76,614, and 398,630. Protective curbs of concrete have been disclosed in U.S. Pat. No. 3,037,433, and construction and use of portable curbs of rubber, plastic, and the like have been taught in U.S. Pat. No. 3,491,660.

The trend in the vehicular paving arts has swung in recent years toward solid curbs made of pre-cast concrete sections or molded-in-place curbs formed from concrete or asphalt. Such curbs require relatively little labor for construction but are susceptible to freezing and impact damage, causing high maintenance expenses to municipal governments.

SUMMARY OF THE INVENTION

The object of this invention is to provide a curb shield, having high impact resistance and imperviousness to water, for protection of curbs alongside vehicular roadways.

Another object is to provide a method for attaching the curb shields to curbs whereby impact resistance and water imperviousness are enhanced.

DESCRIPTION OF THE INVENTION

In satisfaction of these objects and in accordance with this invention, the curb shield of this invention comprises a thin, flexible, tough, impact-resistant fiberglass sheet having a shape generally conforming to the curb to be protected and a length suitable for convenient handling. Preferably, the curb shield has four elongated surfaces and a generally L-shaped cross section. It comprises a relatively wide gutter side, a somewhat narrower top side disposed approximately perpendicularly thereto, a backside rim disposed perpendicularly to the top side and extending in the same direction as the gutter side, and a street rim disposed approximately perpendicularly to the gutter side and extending oppositely to the top side.

The method in satisfaction of these objects comprises:

A. applying a cushioning coating of an asphalt emulsion to the curb to be protected;

B. placing the flexible curb shield of this invention upon the asphalt coating;

C. conjoining the abutted ends of adjacent curb shields so that moisture transmission therebetween is prevented; and D. driving a plurality of drive pins through the backside rim into the curb and through the street rim into the vehicular pavement.

BRIEF DESCRIPTION OF THE DRAWINGS

FIG. 1 is a perspective view of one end of the flexible fiberglass curb shield of this invention, showing a plurality of drive pins driven thereinto.

FIG. 2*a* is a cross-sectional view of an asphalt curb molded in place on top of an asphalt pavement, thereby separating an area of vehicular traffic, on the left, from an area of foot traffic, on the right, while a thick asphalt coating is being applied to the curb with a trowel.

FIG. 2*b* shows the asphalt-coated curb immediately after a flexible curb shield, molded to conform to the shape of the curb, has been loosely placed on top of the asphalt coating.

FIG. 2*c* is a perspective view of two adjacent curb shields being conjoined by an underlying fiberglass strip, one of which is shown beneath the outermost end, and an overlying fiberglass strip which is being applied to the resin-coated abutting ends thereof.

FIG. 2*d* shows the curb shield being bonded to the pavement and to the curb with drive pins driven thereinto with a powder-actuated stud driving device.

DESCRIPTION OF THE INVENTION

The flexible curb shield is molded to conform generally to a curb 15 to be protected as to size, shape, dimensions, and curvature. A curb 15 has a street side 16, which may be vertical or sloping, a top 19, and a walkway side 17. As shown in FIG. 1, a typical curb shield 20 is a unitary device having an upright gutter side 21, a generally horizontal top side 22 extending from the top edge of the gutter side 21, a backside rim 23 depending downwardly from the back edge of the top side 22, and a street rim 24 extending horizontally from the bottom edge of the gutter side 21 and disposed away from the backside rim 23.

This curb shield 20 is typically about 3/16-inch thick, 5 to 10 feet long, 10–15 inches high, and 6–10 inches wide. A suitable radius for the three angles is one-half-inch to 2 inches, a radius of 1½ inches being preferred. Shields 20 can be straight or curved to any desired radius or irregular curvature.

Various colors can be molded into the curb shield 20 to indicate any desired instruction to drivers of motor vehicles and to pedestrians, such as a no-parking zone, a pedestrian crossing zone, etc. Bright yellow is eminently suitable for simply separating vehicular 11 and walking 12 areas.

The curb shield 20 is flexible and exceptionally tough, with an impact strength of at least 20,000 p.s.i., so that vehicular collisions therewith cause local deformation rather than fracture of the shield and are distributed over a relatively large area of the curb 15 instead of being concentrated at the point of impact. The cushioning coating 30 of asphalt emulsion therebeneath is protected from the weather and does not disintegrate or harden. It functions as a shock-absorbing cushion beneath the flexible curb shield 20.

The preferred method of applying the curb shield 20 to a molded curb 15 is to:

A. cover the street side 16, top 19, and walkway side 17 of a curb 15 with a thick coating 30 of an asphalt emulsion, as with a trowel 31, and apply a plurality of suitably spaced strips 37 thereupon;

B. place a plurality of the curb shields 20, after coating the end surfaces thereof with a suitable glass bonding resin, such as a polyester or epoxy resin, over the freshly applied coating 30 and press them firmly and sequentially in place against the coating;

C. conjoin the abutting ends of adjacent curb shields 20*a*, 20*b* with layers of fiberglass cloth and the resin coating, preferably by applying, at intervals corresponding to the length of the curb shields 20, a plurality of underlying strips 37 onto the coating 30 as illustrated in FIG. 2*d*, so that each strip 37 will partly underlie each abutting end, covering the surfaces of each end of the shields 20 with resin 39, placing a plurality of the shields 20*a*, and overlaying a second strip of fiberglass cloth 38 upon this resin 39 so that each joint is covered to form a barrier to moisture intrusion; and D. force a plurality of drive pins 35 through the street rim 24 into the vehicular pavement 11 therebeneath and through the backside rim 23 into the walkway side 17 and further into the interior 18 of the curb 15, such as by using a powder-actuated stud driving device 36, for example, a Remington stud driver, at locations selected by the operator.

Alternatively, glass bonding or adhesive resin 39 is applied to the underlying fiberglass cloth strips 37 after they have been pressed against the coating 30 at suitably spaced intervals and before the curb shields 20*a*, 20*b* are placed thereupon. When the entire length of curb 15 has been thus covered, each of the joints is coated with resin 39, and the overlying strips 38 are applied so as to span the joints. Additional resin can then be applied to the top surfaces of the overlying strips 38, and the surfaces can later be ground to a smooth finish.

The bonding agent, preferably an asphalt emulsion, is a very important part of the curb protection plan of this invention.

A Type Z Cut-back Adhesive is preferred as the asphalt emulsion, and 301 Cove Base Adhesive, sold by the Chicago Mastic Co., 7100 N. Mannheim Road, Rosemont, Desplaines, Ill. 60018 has been found to be highly satisfactory. Such an adhesive must:

a. possess a high critical tack value,
b. set up quickly,
c. bond well to the fiberglass shield 20 and to the curb 15, and
d. be suitable for trowel application to form a layer 30 of approximately ⅛-inch thickness which is capable of functioning as a cushion between the shield 20 and the curb 15.

Rapid-setting emulsions known as RS-1 and RS-2 having a high degree of adhesiveness, as described in U.S. Pat. No. 3,108,971, are entirely satisfactory for forming base coating 30. Because this coating 30 is protected from the weather, it does not disintegrate and have to be regenerated with added maltenes, as discussed in U.S. Pat. No. 3,344,056. It does require a high enough viscosity, as taught for example in U.S. Pat. No. 3,364,046, that it can be applied to a vertical surface with a trowel 31 and stay in place for a reasonable time until curb shields 20*a*, 20*b* are sequentially applied in end-abutting relationship.

The curb protection plan requires a unitary shield having high impact strength, toughness, and flexibility and an underlying cushion of reasonable thickness which multiplies the impact-resisting ability of the shield, affords direct impact protection to concrete, steel, or asphalt curbs therebeneath, and isolates such curbing from the effects of freezing and salt erosion during snow removal by forming a barrier to moisture intrusion.

It should be understood that this invention can be modified in various ways without departing from the spirit thereof and consequently should be interpreted only in light of the following claims when broadly construed.

What is claimed is:

1. A curb protection plan, for a curb alongside vehicular roadways, that provides impact resistance and protection against freezing and salt damage, comprising, in combination:

A. a unitary shield having high impact strength, toughness, and flexibility and a shape conforming generally to said curb to be protected as to size, shape, dimensions, and curvatures, said unitary shield being a thin, flexible, tough, impact-resistance fiberglass sheet having a generally L-shaped cross section and comprising:
   1. an approximately upright gutter side having a top edge and a bottom edge,
   2. a generally horizontal top side extending from said top edge and having a back edge,
   3. a backside rim extending downwardly from said back edge, and
   4. a street rim extending from said bottom edge and disposed oppositely to said top side, said unitary shield further comprising a plurality of shield sections which are conjoined end-to-end with a resin and fiber-glass cloth to form waterproof joints at intervals corresponding to the length of said shield sections as a part of a barrier to moisture intrusion; and B. an underlying shock-absorbing cushion of reasonable thickness which:
   1. multiplies the impact-resisting ability of said shield,
   2. affords direct impact protection to said curb therebeneath,
   3. isolates said curb from the effects of freezing and salt erosion during snow removal by forming said barrier to moisture intrusion, and
   4. bonds to said shield and to said curb.

2. The curb protection plan of claim 1 wherein said cushion is a layer of asphalt emulsion.

3. The curb protection plan of claim 2 wherein said asphalt emulsion is a Type Z cut-back adhesive which:

A. possesses a high critical tack value;
B. sets up quickly; and
C. is suitable for trowel application.

* * * * *